US010924847B2

(12) United States Patent
Ryle

(10) Patent No.: US 10,924,847 B2
(45) Date of Patent: Feb. 16, 2021

(54) MICROPHONE THAT FUNCTIONS AS EITHER A DIGITAL WIRELESS MICROPHONE OR A WIRED PASSIVE MICROPHONE

(71) Applicant: Yamaha Guitar Group, Calabasas, CA (US)

(72) Inventor: Marcus Ryle, Westlake Village, CA (US)

(73) Assignee: Yamaha Guitar Group, Inc., Calabasas, CA (US)

( * ) Notice: Subject to any disclaimer, the term of this patent is extended or adjusted under 35 U.S.C. 154(b) by 0 days.

(21) Appl. No.: 16/247,408

(22) Filed: Jan. 14, 2019

(65) Prior Publication Data

US 2020/0228895 A1 Jul. 16, 2020

(51) Int. Cl.
*H04R 3/00* (2006.01)
*H04R 29/00* (2006.01)

(52) U.S. Cl.
CPC ..... *H04R 3/00* (2013.01); *H04R 29/004* (2013.01); *H04R 2420/07* (2013.01); *H04R 2420/09* (2013.01)

(58) Field of Classification Search
CPC .... H04R 3/00; H04R 29/004; H04R 2420/07; H04R 2420/09
USPC ..... 381/63, 74, 77, 92, 94.5, 111, 122, 174, 381/334, 358, 369, 370, 376
See application file for complete search history.

(56) References Cited

U.S. PATENT DOCUMENTS 4,837,812 A 6/1989 Takahashi et al.
4,972,457 A 11/1990 O'Sullivan
6,084,950 A 7/2000 Pinault
6,222,940 B1 4/2001 Prince et al.
6,987,949 B2 1/2006 Taniguchi et al.
7,061,365 B2 6/2006 Izumi
7,818,037 B2 10/2010 Lair et al.
8,023,984 B2 9/2011 Jin et al.
(Continued)

FOREIGN PATENT DOCUMENTS

CN 107396218 A 11/2017
WO 2011144824 A1 11/2011

OTHER PUBLICATIONS

Zaxcom Introduces New Plu-on Digital Recording Wireless Transmitter Featuring NeverClip; https://zaxcom.com/zaxcom-introduces-new-plug-on-digital-recording-wireless-transmitter-featuring-neverclip/; Apr. 12, 2012.
(Continued)

*Primary Examiner* — Vivian C Chin
*Assistant Examiner* — Friedrich Fahnert
(74) *Attorney, Agent, or Firm* — Womble Bond Dickinson (US) LLP

(57) ABSTRACT

Embodiments relate to a microphone that functions as either a digital wireless microphone or a wired passive microphone. The microphone may comprise: a microphone transducer; an analog to digital converter (ADC) coupled to the microphone transducer to convert an analog audio signal from the microphone transducer to a digital audio signal; an antenna coupled to the ADC; and an analog connector coupled to the microphone transducer. In a wireless mode, the antenna transmits the digital audio signal to a digital receiver. Alternatively, in a wired mode, a cable that is coupled to the analog connector transmits the analog audio signal without requiring any power.

20 Claims, 3 Drawing Sheets

(56) References Cited

U.S. PATENT DOCUMENTS 8,260,348 B2 9/2012 Sherman
8,483,412 B2 7/2013 Statham et al.
9,277,308 B2 * 3/2016 Kung ..... H04W 84/10
2003/0223592 A1 * 12/2003 Deruginsky ..... H04M 1/6008 381/92
2009/0304196 A1 * 12/2009 Patton ..... H04R 3/04 381/63
2009/0323975 A1 * 12/2009 Groesch ..... H04R 1/1091 381/71.1
2010/0119099 A1 * 5/2010 Haupt ..... G06F 3/165 381/369
2011/0044477 A1 * 2/2011 Huang ..... H04R 1/083 381/122
2011/0249831 A1 10/2011 Bellamy
2012/0183159 A1 * 7/2012 Johnson ..... H04M 1/6008 381/120
2012/0213388 A1 * 8/2012 Hudspeth ..... H04R 9/08 381/114
2012/0265539 A1 * 10/2012 Hilderman ..... G10H 1/361 704/500
2013/0094687 A1 * 4/2013 Weinstein ..... H04R 1/10 381/334
2014/0363017 A1 * 12/2014 Kung ..... H04R 1/08 381/77
2015/0078575 A1 * 3/2015 Selig ..... H04R 1/1091 381/74
2016/0142804 A1 * 5/2016 Naito ..... H04R 1/04 381/94.5
2017/0201818 A1 * 7/2017 Smith ..... H04R 1/08
2017/0280214 A1 * 9/2017 Koper ..... A42B 3/306
2017/0281416 A1 * 10/2017 O'Leary ..... H04R 25/604
2018/0041832 A1 * 2/2018 Shultz ..... H04R 1/086
2019/0159001 A1 * 5/2019 Wang ..... H04M 1/6066
2020/0288241 A1 * 9/2020 Song ..... H04M 1/02

OTHER PUBLICATIONS

Sennheiser SKP 100 G4 Plug-On Transmitter for Dynamic Microphones A: (516 to 558 MHz), B&H Photo; https://www.bhphotovideo.com/c/search?setIPP=100&ci=15420&fct=fct_type_1369%7cplug-in&srtclk=itemspp&ipp=100&N=3685665711&; May 31, 2019.
PylePro Dual Function Wireless/Wired Microphone System, Includes Mic & Wireless Adapter Receiver; https://www.pyleaudio.com/sku/PDWM100/; May 31, 2019.
PylePro Professional Wired/Wireless Microphone Includes Mic & Wireless Adapter Receiver; https://www.pyleaudio.com/sku/PDWM94/; May 31, 2019.
RGE 2 in 1 Wired/Wireless Microphone; https://www.alibaba.com/product-detail/2-in-1-wired-wireless-microphone_211999572.html?spm=a2700.7724838.2017115.209.1c52738ealTRaL; May 31, 2019.
Zaxcom Unveils First-Of-Its-Kind Handheld Microphone; https://zaxcom.com/zaxcom-unveils-first-of-its-kind-handheld-microphone/; Sep. 15, 2017.
Handheld Wireless Professional Microphone dual Function Wireless/Wired System; https://www.alibaba.com/product-detail/Handheld-Wireless-Professional-Microphone-Dual-Function_60787252970.html; May 31, 2019.
International Search Report for corresponding application No. PCT/US2020/012411 dated Feb. 11, 2020.

* cited by examiner

MICROPHONE THAT FUNCTIONS AS EITHER A DIGITAL WIRELESS MICROPHONE OR A WIRED PASSIVE MICROPHONE

BACKGROUND

During a recording or live performance, singers often desire the freedom of being able to have their voice audio signals being connected to recording or amplification devices without the encumbrance of an electrical cable and prefer the use of wireless microphones. However, some wireless microphones may have issues related to radio frequency interference. Additionally, wireless microphones cannot operate without power, which renders them non-functional if the batteries are not charged or if no replacement batteries are available. Therefore, in some instances, singers and audio engineers prefer wired microphones that include an electrical cable to recording or amplification devices, as a replacement or a backup for wireless microphones. This is usually accomplished by supplying both wireless and wired microphones for use depending on the specific need at the time.

Wired microphones are currently available in the marketplace that can be turned into a wireless microphone. These types of wired microphones may have a transmitter/antenna attached to them—to turn the wired microphone into a wireless microphone. The transmitter/antenna may be sold as a separate accessory for attachment to a wired microphone to turn the wired microphone into a wireless microphone. Alternatively, the wired microphone may come with transmitter/antenna for attachment, as a part of a single microphone product, such that, it can be used as either a wired microphone or a wireless microphone.

It should be noted that these microphone products require the user to both: attach an antenna and switch the microphone to a "wireless" mode. Furthermore, these existing microphone products involve traditional analog wireless system technology.

At least one high-end wireless microphone, the Zaxcom ZMT3-HH, includes the capability to transmit wireless audio, record audio within the microphone, and simultaneously output audio out a cable. But its primary function is as a wireless microphone, and the addition of a cabled audio output still requires that the wireless microphone has power. As a result, this product cannot be used as a traditional stand-alone wired passive microphone, which does not require any power.

DETAILED DESCRIPTION

Embodiments of the invention generally relate to a microphone that functions as either a digital wireless microphone or a wired passive microphone. The selection of the wireless mode is automatic and no particular user action is required for the microphone to be used in the wireless mode. To be used in the wired mode, the user simply connects a cable to the analog connector of the microphone and the wired mode is automatically selected, and the wireless mode is disabled. In particular, in the wired mode, the power to the wireless components of the microphone is disengaged such that the power from the battery is not drained. In this way, in the wired implementation, the microphone acts as a passive microphone not requiring power. When utilized in a wireless mode, the microphone operates in a digital wireless system environment to wirelessly transmit audio signals to the audio output device, and when operated in the wired mode, the microphone directly transmits audio signal to the audio output device by the cable. In particular, as previously described, when operating in the wired mode, the microphone operates as a passive microphone and does not require power from a battery or any other power source.

Figure 1:
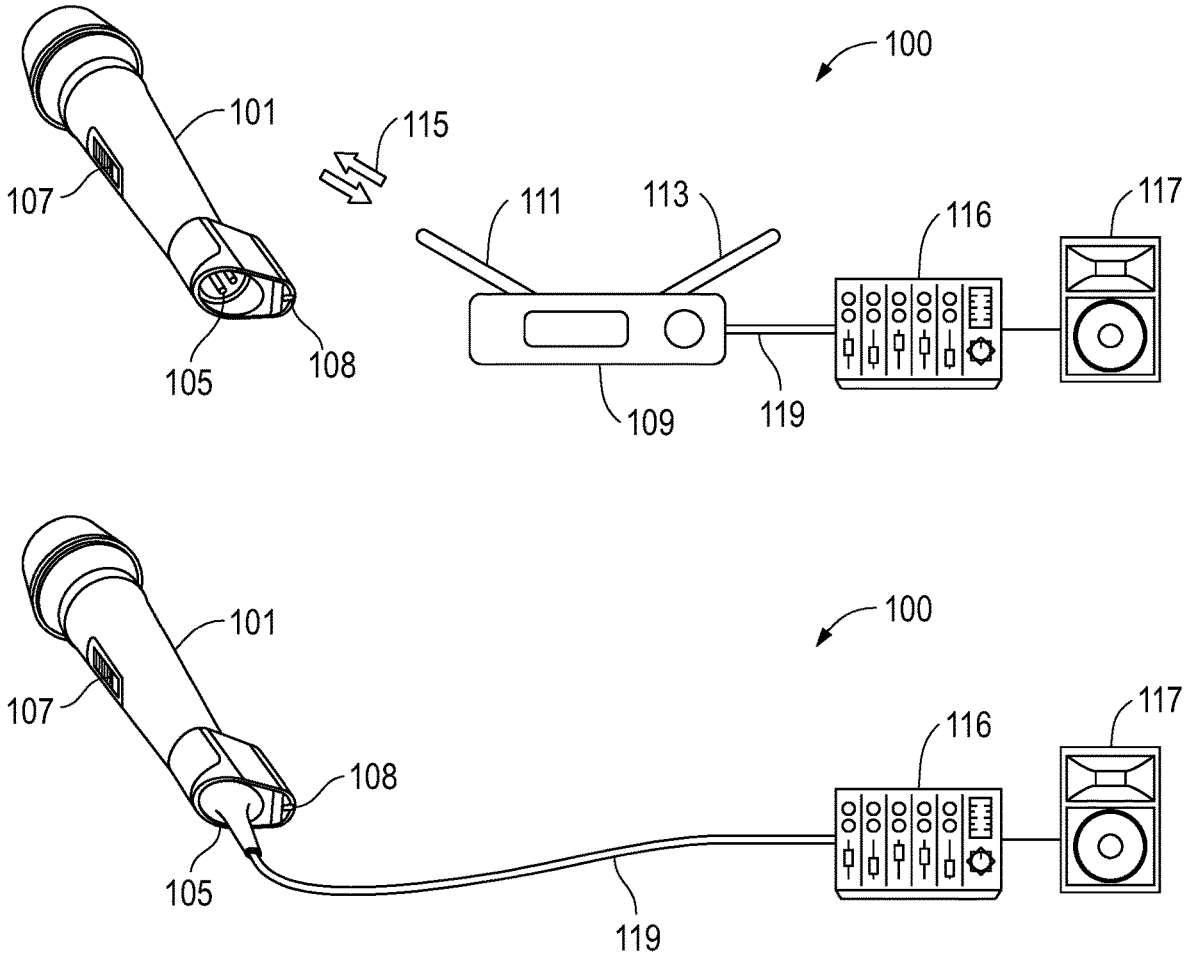
FIG. 1 is an illustration of one example system for a microphone that functions as either a digital wireless microphone or a wired passive microphone.

With reference now to FIG. 1, FIG. 1 is an illustration of one example system 100 for the wireless transmission of digital audio signals or the wired transmission of analog audio signals by a microphone 101. System 100 may include microphone 101, a digital receiver 109 with internal or attached antennas, a mixer 116, and an audio output device 117. Each of the structures, features, and/or characteristics of system 100 will be described in more detail hereafter. In example system 100, an audio source, such as microphone 101, can generate digital audio signals and/or analog audio signals. Although an example of a microphone is provided, it should be appreciated that the audio source is not limited to a microphone and any sort of musical instrument or device that generates a digital or analog audio signal may be utilized.

Microphone 101 may function as either a digital wireless microphone or a wired passive microphone. When used as digital wireless microphone, in a wireless mode, microphone 101 utilizes an antenna 108 directly built into the microphone 101 to transmit digital audio signals. In other examples, the antenna may be attached to the microphone at any suitable location. Microphone 101 may generate one or more digital audio signals 115 that are transmitted by the antenna 108 to digital receiver 109, which has antennas 111 and 113. Antennas 111 and 113 can be attached to digital receiver 109, or alternatively, antennas 111-113 can be built into digital receiver 109, so as to give the facade of digital receiver 109 being one device without any antennas. The one or more digital audio signals 115 received by digital receiver 109 can be processed and converted, by digital receiver 109, back into the one or more analog audio signals that were generated by microphone 101. Digital receiver 109 can send the one or more digital audio signals 115 to an audio output device 117 for playback through a cable 119 and, optionally, through a mixer 116. The audio output device 117 can be a playback device (e.g., an amplifier, a speaker, a public address system with speaker, etc.). It should be appreciated that the audio output device is not limited to an amplifier, speaker, etc., but can be any audio output device known in the art. Also, it should be appreciated that the digital and/or analog audio signals from the digital receiver 109 may be transmitted to a computer for editing and storage.

Further, as previously described, microphone 101 may function as a wired passive microphone. When used as wired passive microphone, in a wired mode, microphone 101 may transmit an analog audio signal from microphone 101 to an audio output device 117 for playback. As an example, microphone 101 may include an audio connector 105 (e.g., an XLR connector) to which a cable 119 is connected to the audio output device 117 for playback. In this way, microphone 101 can send analog audio signals to the audio output device 117 for playback through cable 119 and, optionally, through a mixer 116. As previously described, the audio output device 117 can be a playback device (e.g., an amplifier, a speaker, a public address system with speaker, etc.). It should be appreciated that the audio output device is not limited to an amplifier, speaker, etc., but can be any audio output device known in the art. Also, it should be appreciated that the analog audio signals from the microphone 101 may be transmitted to a computer for editing and storage. Also, as can be seen in FIG. 1, microphone 101 may include an on/off switch 107.

As an example, in one embodiment, a system 100 for use with microphone 101 that functions as either a digital wireless microphone or a wired passive microphone may comprise: a digital receiver 109 and an audio output device 117. The microphone 101 may comprise: a microphone transducer; an analog to digital converter (ADC) coupled to the microphone transducer to convert an analog audio signal from the microphone transducer to a digital audio signal; an antenna 108 coupled to the ADC; and an analog connector 105 coupled to the microphone transducer, wherein, in a wireless mode, the antenna transmits digital audio signals 115 to the digital receiver 109 for playing the digital audio signal through the audio output device 117, or, in a wired mode, a cable 119 coupled to the analog connector 105 transmits the analog audio signal without requiring any power to the audio output device 117 for playing the analog audio signal through the audio output device 117. A mixer 116 may be utilized in either the wireless mode or wired mode implementation. Also, in particular, as will be described, the wireless mode of the microphone 101 may be automatically selected such that the antenna 108 transmits the digital audio signals 115 to the digital receiver 109 for playing through the audio output device 117 without user interaction. On the other hand, the wired mode of the microphone 101 may be automatically selected if the cable 119 is connected to the analog connector 105 such that the cable 119 transmits the analog audio signal to the audio output device 117 for playback. It should be noted that in the wired mode, microphone 101 operates as a passive microphone and does not require any power. Various examples will be hereafter described in more detail.

Figure 2:
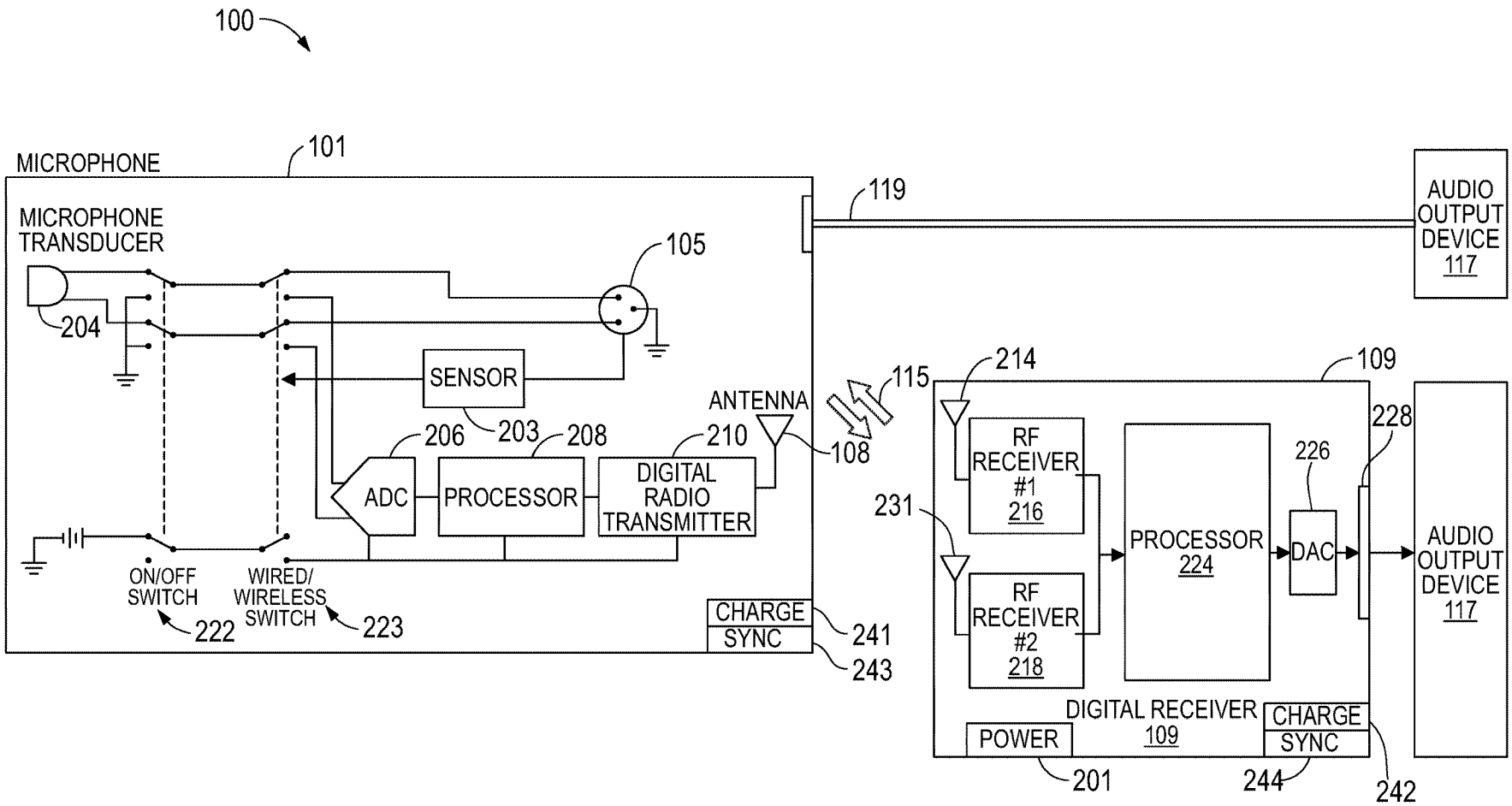
FIG. 2 is a block diagram of an example system for a microphone that functions as either a digital wireless microphone or a wired passive microphone.

With additional reference to FIG. 2, in one embodiment, a system 100 for use with microphone 101 that functions as either a digital wireless microphone or a wired passive microphone may comprise: a digital receiver 109 and an audio output device 117. The microphone 101 may comprise: a microphone transducer 204; an analog to digital converter (ADC) 206 coupled to the microphone transducer 204 to convert an analog audio signal from the microphone transducer 204 to a digital audio signal; an antenna 108 coupled to the ADC 206; and an analog connector 105 coupled to the microphone transducer 204, wherein, in a wireless mode, the antenna 108 transmits digital audio signals 115 to the digital receiver 109 for playing the digital audio signal through the audio output device 117, or, in a wired mode, a cable 119 coupled to the analog connector 105 transmits the analog audio signal without requiring any power to the audio output device 117 for playing the analog audio signal through the audio output device 117. A mixer may be utilized in either the wireless mode or wired mode implementation, as has been previously described. Also, in particular, as will be described, the wireless mode of the microphone 101 may be automatically selected such that the antenna 108 transmits the digital audio signal 115 to the digital receiver 109 for playing through the audio output device 117 without user interaction. On the other hand, the wired mode of the microphone 101 may be automatically selected if the cable 119 is connected to the analog connector 105 such that the cable 119 transmits the analog audio signal to the audio output device 117 for playback. It should be noted that in the wired mode, microphone 101 operates as a passive microphone and does not require any power. Various examples will be hereafter described in more detail.

As an example, in a wireless mode, a user may speak or sing into microphone 101 and the microphone transducer 204 may convert the user's sound into analog audio signals. The analog audio signals may be converted by the analog to digital converter (ADC) 206 into digital audio signals. The digital audio signals may further undergo processing by processor 208 to ensure the digital audio signals comply with the protocols of the digital audio signal system with the digital receiver 109. Further, the digital audio signals may be processed and transmitted as radio waves by digital radio transmitter 210 and antenna(s) 108 as wireless digital audio signals 115 to the digital receiver 109. The antenna(s) 108 may be included internally in the microphone 101 or may be located externally on the microphone. It should be noted that, in one embodiment, a rechargeable battery 220 may be used to power the microphone 101 in the wireless mode. It should be appreciated these are just examples of power methods for the microphone and that other methods such as standard batteries or other power storage means may be utilized to power the microphone in the wireless mode. Also, an on/off switch 222 coupled to an appropriate physical switch/button (e.g., on/off switch/button 107 from FIG. 1) allows microphone 101 to be turned on and off by a user.

In one embodiment, assuming the dual on/off switch 222 is turned on by the user, the wireless mode is automatically selected by microphone 101 and a user does not have to select the wireless mode. In this case, digital audio signals 115 are automatically wirelessly transmitted from the antenna(s) 108 to the digital receiver 109, as will be described in more detail hereafter. In this instance, power is provided by battery 220 to the ADC 206, processor 208, digital radio transmitter 210, antenna(s) 108, to perform the wireless functions. The only time a wired mode is utilized is if a cable 119 is connected to the analog connector 105, in which case, the analog audio signal from the microphone transducer 204 of the user's sound may be transmitted through the cable 119 to the audio output device 117 for playback, as has been described. In one embodiment, the analog connector 105 may be an XLR connector (e.g., three pin (e.g., positive, negative, ground)). Similarly, the cable 119 may be a cable with an input XLR connector and an output XLR connector. The audio output device 117 may further include a similar XLR connector. It should be appreciated that an XLR connection is just one example of an analog connection. Further, as has been described, audio output device 117 can be an amplifier, speaker, etc., and/or other audio output devices that are well known in the art. To determine the wired mode, in one embodiment, a sensor 203 may be utilized, in which, the sensor 203 determines whether a cable 119 is connected to the analog connector 105, and, if so, the sensor 203 turns wired/wireless switch 223 from wireless mode to wired mode to disable the wireless mode and to disable wireless communication utilizing the ADC 206, processor 208, digital radio transmitter 210, and antenna(s) 108. In particular, with switch 223 in wired mode, power from battery 220 is not provided to the ADC 206, processor 208, digital radio transmitter 210, antenna(s) 108, to perform the wireless functions. Thus, the wired mode is automatically selected when a cable 119 is connected to the analog connector 105 (e.g., an XLR connector) and power is not drained from the battery 220 and power is not used at all such that microphone 101 operates as a passive microphone. In one embodiment sensor 203 and the wired/wireless switch 223 can be physically integrated into analog connector 105 as a passive switch that requires no power and is physically switched from wireless mode to wired mode as a result of physically connecting cable 119 to analog connector 105. Alternatively, wired/wireless switch 223 could be a simple mechanical switch that is set by the user.

However, as previously described, when automatically operating in the wireless mode, without a physical cable 119 being connected to microphone 101 such that the wired mode is not implemented, the analog audio signals of the user's sound from the microphone transducer 204 may be converted by the analog to digital converter (ADC) 206 into digital audio signals. The digital audio signals may further undergo processing by processor 208 to ensure the digital audio signals comply with the protocols of the digital audio signal system with the digital receiver 109. Further, the digital audio signals may be processed and transmitted as radio waves by digital radio transmitter 210 and antenna(s) 108 as wireless digital audio signals 115 to the digital receiver 109. As an example, digital receiver 109 may include RF receiver #1 216, RF receiver #2 218, processor 224, digital to analog converter ("DAC") 226, and output device 228, each of which are described below. RF receiver #1 216 and RF receiver #2 218 may use antenna 214 and antenna 231, respectively, to receive the one or more digital signals 115 from digital radio transmitter 210. It should be appreciated that two RF receivers and two antennas are used by system 100 to increase the likelihood that the one or more digital audio signals 115 are received without any errors ("one or more error-free digital audio signals"). It should also be appreciated that more than two RF receivers and/or more than two antennas may be used by system 100, to increase the likelihood that the one or more digital audio signals are received without any errors. If the one or more error-free digital signals 115 are received by RF receiver #1 216 and/or RF receiver #2 218, the one or more error-free digital signals 115 can be sent to processor 224, which is coupled to RF receiver #1 216 and/or RF receiver #2 218. Processor 224 can decode the one or more digital signals 233. Digital receiver 109 may optionally include a DAC 226 coupled to processor 224 to convert the one or more digital signals 115 that were processed by processor 224 into one or more analog audio signals. It should also be appreciated that the digital signals 115 between the digital receiver 109 and microphone 101 may be bi-directional such that they communicate with one another as to digital signal protocol, wireless channel selection, etc. In one embodiment, the wireless channel for the transmission of digital audio signal is automatically selected by the digital receiver 109 and/or the microphone 101.

It should be noted that DAC 226 may or may not be utilized dependent upon the type of audio output device 117. For example, the audio output device may be a computer for audio processing and may rely upon the digital audio signal for digital processing and editing, or, on the other hand, the audio output device 117 may be an analog amplifier or speaker to play back an analog audio signal. Digital receiver 109 may include a button selectable by a user to indicate whether or not an audio output device 117 is analog or digital, so that digital receiver 109 can turn on or off DAC 226. Alternatively, digital receiver 109 may simply determine whether a digital or analog signal is needed and select or deselect DAC 226. In either event, the digital audio signals 115 can be sent from processor 224 and/or DAC 226 to audio output 228 of digital receiver 109, which may send the audio signals 115 (whether in digital or analog form) to the audio output device 117.

Also, in one embodiment, microphone 101 may include a charge connector 241 that can connect to a charge connector 242 of digital receiver 109 that may be utilized to charge the rechargeable battery 220 of the microphone 101, when they are connected together, as will be described in more detail hereafter. Additionally, in one embodiment, microphone 101 may include a sync connector 243 that can connect to a sync connector 244 of digital receiver 109 that may be utilized to synchronize the wireless channels that the microphone 101 and digital receiver 109 utilize to wirelessly communicate with one another, when they are connected together, as will be described in more detail hereafter.

Figure 3:
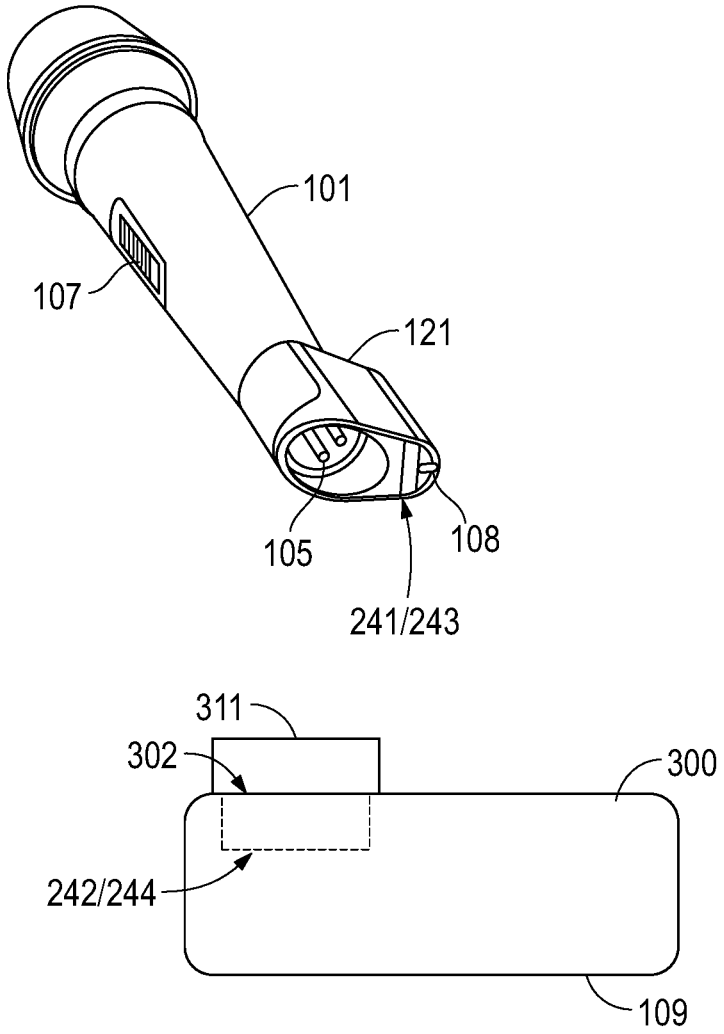
FIG. 3 are illustrations of example structures for the microphone and the digital receiver.

With additional reference to FIG. 3, example structural configurations of the microphone 101 and digital receiver 109 will be described. As can be seen in FIG. 3, microphone 101 may have an approximately U-shaped tapered housing structure 121 at the bottom end of the microphone that includes a circular cavity to house the analog connector 105 (e.g., an XLR connector) and a back-end portion to house antenna 108, as well as, charge connector 241 and sync connector 243. For example, antenna 108, charge connector 241, and sync connector 243 may be at the bottom end of the back-end portion of the housing 121. Further, digital receiver 109 may include an approximately rectangular shaped housing 300 that includes a docking cavity or receptacle 302 to receive the bottom end of housing 121 and audio connector 105 of the microphone 101. Housing 300 of digital receiver 109 may also include a back-wall 311 to house the digital receiver antennas, although it should be appreciated that the antennas of the digital receiver may be located anywhere, this being just one example. As an example, the bottom end of the housing 121 of the microphone 101 may be inserted into the receptacle 302 of the digital receiver 109 such that the microphone 101 is thereby docked therein, and the charge contacts 242 of the digital receiver 109 may mate with the charge contacts 241 of the microphone 101 to charge the rechargeable battery 220 of the microphone 101. Further, when the bottom end of the housing 121 is inserted in the receptacle 302 of the digital receiver 109, and the microphone 101 is thereby docked therein, the sync contacts 244 of the digital receiver 109 may mate with sync contacts 243 of the microphone 101 such that the digital receiver 109 and microphone 101 can communicate with each other to synchronize wireless RF channels for digital wireless communication. It should be appreciated that the charging and synchronization connections may be by direct electrical connections or inductive coupling connections. Further, it should be appreciated that this is just one example of structures of the microphone 101 and digital receiver 109 to interconnect the microphone to the digital receiver for charging and synchronization and that many other physical implementations are possible as to structures and locations of the antenna, sync contacts, charge contacts, etc., and this is merely an example.

As has been described, embodiments of the invention generally relate to a microphone 101 that functions as either a digital wireless microphone or a wired passive microphone. The selection of the wireless mode is automatic and no particular user action is required for the microphone to be used in the wireless mode. To be used in the wired mode, the user simply connects a cable to the analog connector of the microphone and the wired mode is automatically selected, and the wireless mode is disabled. In particular, in the wired mode, the power to the wireless components of the microphone is disengaged such that the power from the battery is not drained. In this way, in the wired implementation, the microphone acts as a passive microphone not requiring power. When utilized in a wireless mode, the microphone operates in a digital wireless system environment to wirelessly transmit audio signals to the audio output device, and when operated in the wired mode, the microphone directly transmits audio signal to the audio output device by the cable. In particular, as previously described, when operating in the wired mode, the microphone operates as a passive microphone and does not require power from a battery or any other power source.

In the prior description, various embodiments have been described in detail. However, such details are included to facilitate understanding of the system, apparatus, and method for the microphone and to describe example embodiments. Such details should not be used to limit the microphone to the particular embodiments described because other variations and embodiments are possible while staying within the scope of the microphone. Furthermore, although numerous details are set forth in order to provide a thorough understanding of the microphone, it will be apparent to one skilled in the art that these specific details are not required in order to practice the use of the microphone. In other instances, details such as, well-known methods, types of data, protocols, procedures, components, processes, interfaces, electrical structures, circuits, etc., are not described in detail, or are shown in block diagram form, in order not to obscure aspects of the invention. Furthermore, aspects of the microphone may be implemented in hardware, software, firmware, middleware, or a combination thereof.

In the previous description, certain terminology was used to describe features of the invention. For example, a "component," or "computing device," or "client device, or "computer" includes hardware and/or software module(s) that are configured to perform one or more functions.

Further, a "processor" is logic that processes information. Examples of a processor include a central processing unit (CPU), microprocessor, an application specific integrated circuit (ASIC), a digital signal processor (DSP), a microcontroller, a finite state machine, a field programming gate array (FPGA), combinatorial logic, etc.

A "module" or "software module" is executable code such as an operating system, an application, an applet, or a routine. Modules may be stored in any type of memory, namely suitable storage medium such as a programmable electronic circuit, a semiconductor memory device, a volatile memory (e.g., random access memory, etc.), a nonvolatile memory (e.g., read-only memory, flash memory, etc.), a floppy diskette, an optical disk (e.g., compact disk or digital versatile disc "DVD"), a hard drive disk, tape, or any kind of interconnect (defined below).

A "connector," "interconnect," or "link" is generally defined as an information-carrying medium that establishes a communication pathway. Examples of the medium include a physical medium (e.g., electrical cable, electrical fiber, optical fiber, bus traces, etc.) or a wireless medium (e.g., air in combination with wireless signaling technology).

"Information" or "data stream" is defined as data, address, control, or any combination thereof. For transmission, information may be transmitted as a message, namely a collection of bits in a predetermined format. One particular type of message is a frame including a header and a payload, each having a predetermined number of bits of information.

While a microphone and its various functional components have been described in particular embodiments, it should be appreciated the embodiments of the microphone can be implemented in hardware, software, firmware, middleware or a combination thereof and utilized in systems, subsystems, components, or sub-components thereof.

When implemented in software or firmware, the elements of a system and method for the microphone are the instructions/code segments to perform the necessary tasks. The program or code segments can be stored in a machine readable medium, such as a processor readable medium or a computer program product, or transmitted by a computer data signal embodied in a carrier wave, or a signal modulated by a carrier, over a transmission medium or communication link. The machine-readable medium or processor-readable medium may include any medium that can store or transfer information in a form readable and executable by a machine (e.g. a processor, a computer, etc.). Examples of the machine/processor-readable medium include an electronic circuit, a semiconductor memory device, a ROM, a flash memory, an erasable programmable ROM (EPROM), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

While a system and method for the microphone has been described with reference to illustrative embodiments, this description is not intended to be construed in a limiting sense. Various modifications of the illustrative embodiments, as well as other embodiments of the system and method for the microphone, which are apparent to persons skilled in the art to which the system and method for the microphone pertains are deemed to lie within the spirit and scope of the system and method for the microphone.

What is claimed is:

1. A microphone that functions as either a digital wireless microphone or a wired passive microphone comprising:

a microphone transducer;

an analog to digital converter (ADC) coupled to the microphone transducer to convert an analog audio signal from the microphone transducer to a digital audio signal;

an antenna coupled to the ADC; and an analog connector coupled to the microphone transducer, and a sensor and switch coupled to the analog connector, wherein, in a wireless mode, the antenna transmits the digital audio signal, or, in a wired mode, a cable coupled to the analog connector transmits the analog audio signal such that the microphone operates as a passive microphone without requiring any power, wherein, the wireless mode is automatically selected such that the antenna transmits the digital audio signal or the wired mode is selected if a cable is connected to the analog connector such that the cable transmits the analog audio signal and, wherein, the sensor determines whether the cable is connected to the analog connector, and if so, the switch automatically turns the wireless mode off such that the power is not drained from a battery of the microphone.

2. The microphone of claim 1, wherein the analog connector is an XLR connector.

3. The microphone of claim 1, wherein a wireless channel is automatically selected for transmission of the digital audio signal by the antenna in the wireless mode.

4. The microphone of claim 1, wherein the antenna is included internally in the microphone.

5. The microphone of claim 1, wherein the antenna is included externally on the microphone.

6. The microphone of claim 1, wherein the battery is a rechargeable battery to power the microphone.

7. The microphone of claim 6, wherein the rechargeable battery is rechargeable by docking the microphone in a receptacle of a receiver.

8. The microphone of claim 7, wherein, when the microphone is docked in the receptacle of the receiver, the receiver and microphone communicate with each other to synchronize wireless channels.

9. The microphone of claim 1, further comprising an on/off switch.

10. The microphone of claim 1, further comprising a wired/wireless switch to allow for manual selection of the wired mode or the wireless mode.

11. A system for use with a microphone that functions as either a digital wireless microphone or a wired passive microphone, the system comprising:

an audio output device;

a digital receiver coupled to the audio output device; and a microphone, the microphone comprising:

a microphone transducer;

an analog to digital converter (ADC) coupled to the microphone transducer to convert an analog audio signal from the microphone transducer to a digital audio signal;

an antenna coupled to the ADC; and an analog connector coupled to the microphone transducer, and a sensor and switch coupled to the analog connector, wherein, in a wireless mode, the antenna transmits the digital audio signal to the digital receiver for playing the digital audio signal through the audio output device, or, in a wired mode, a cable coupled to the analog connector transmits the analog audio signal to the audio output device for playing the analog audio signal through the audio output device such that the microphone operates as a passive microphone without requiring any power in the wired mode, wherein, the wireless mode is automatically selected such that the antenna transmits the digital audio signal to the digital receiver for playing through the audio output device or the wired mode is selected if a cable is connected to the analog connector such that the cable transmits the analog audio signal to the audio output device for playing through the audio output device and, wherein, the sensor determines whether the cable is connected to the analog connector, and if so, the switch automatically turns the wireless mode off such that the power is not drained from a battery of the microphone.

12. The system of claim 11, wherein the analog connector of the microphone is an XLR connector.

13. The system of claim 11, wherein a wireless channel is automatically selected for transmission of the digital audio signal by the antenna in the wireless mode.

14. The system of claim 11, wherein the antenna is included internally in the microphone.

15. The system of claim 11, wherein the antenna is included externally on the microphone.

16. The system of claim 11, wherein the battery is a rechargeable battery to power the microphone.

17. The system of claim 16, wherein the rechargeable battery is rechargeable by docking the microphone in a receptacle of the digital receiver.

18. The system of claim 17, wherein, when the microphone is docked in the receptacle of the digital receiver, the digital receiver and microphone communicate with each other to synchronize wireless channels.

19. The system of claim 11, wherein the microphone further comprises an on/off switch.

20. The system of claim 11, further comprising a wired/wireless switch to allow for manual selection of the wired mode or the wireless mode.

* * * * *